US007040929B2

(12) United States Patent
Defieuw et al.

(10) Patent No.: US 7,040,929 B2
(45) Date of Patent: May 9, 2006

(54) SURFACTANTS FOR USE IN SUBSTANTIALLY LIGHT-INSENSITIVE THERMOGRAPHIC RECORDING MATERIALS

(75) Inventors: Geert Defieuw, Bonheiden (BE); Johan Loccufier, Zwijnaarde (BE); Luc Van Steen, Malderen (BE); Etienne Van Thillo, Essen (BE)

(73) Assignee: Agfa-Gevaert, Mortsel (BE)

( * ) Notice: Subject to any disclaimer, the term of this patent is extended or adjusted under 35 U.S.C. 154(b) by 186 days.

(21) Appl. No.: 10/601,361

(22) Filed: Jun. 23, 2003

(65) Prior Publication Data

US 2005/0053871 A1 Mar. 10, 2005

(30) Foreign Application Priority Data

Jun. 6, 2003 (EP) ..... 03101662

(51) Int. Cl.
*G03C 1/37* (2006.01)
*G03C 1/498* (2006.01)

(52) U.S. Cl. ..... 439/631; 430/523; 430/529; 430/531; 430/636; 430/620; 430/964; 503/201

(58) Field of Classification Search ..... 430/617, 430/619, 964, 636, 523, 631, 620, 611, 600, 430/529, 531; 503/201, 212
See application file for complete search history.

(56) References Cited

U.S. PATENT DOCUMENTS 2,053,822 A 9/1936 Graenacher et al.
3,514,597 A 5/1970 De Haes et al.
3,704,130 A 11/1972 Pollet et al.
3,901,769 A 8/1975 Takatori et al.
4,011,082 A * 3/1977 Sakai et al. ..... 430/302
4,639,408 A 1/1987 Kitaguchi et al.
5,422,234 A * 6/1995 Bauer et al. ..... 430/527
6,780,576 B1 * 8/2004 Van Thillo et al. ..... 430/523

FOREIGN PATENT DOCUMENTS

EP 0 809 144 A1 11/1997

OTHER PUBLICATIONS

Search Report for EP 03 10 1662 (Nov. 5, 2003).

* cited by examiner

*Primary Examiner*—Thorl Chea
(74) *Attorney, Agent, or Firm*—Leydig, Voit & Mayer, Ltd.

(57) ABSTRACT

A substantially light-insensitive monosheet thermographic recording material comprising a support and on one side of said support a thermosensitive element, wherein said thermographic recording material contains at least one compound represented by formula (I):

(I)

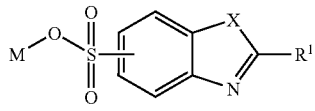

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; X is —O—, —S— or —N($R^2$)—; and $R^2$ is hydrogen, a —$(CH_2)_mSO_3M$ group or a

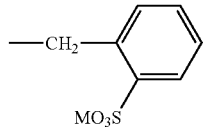

group; and m is an integer between 1 and 5.

19 Claims, No Drawings

SURFACTANTS FOR USE IN SUBSTANTIALLY LIGHT-INSENSITIVE THERMOGRAPHIC RECORDING MATERIALS

FIELD OF THE INVENTION

The present invention concerns substantially light-insensitive thermographic recording materials containing sulphobenzimidazole compounds.

BACKGROUND OF THE INVENTION

U.S. Pat. No. 2,053,822 discloses a process for the manufacture of sulphonic acids, consisting in treating with sulphonating agents imidazole derivatives having the atom grouping

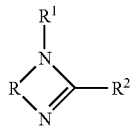

aromatic radical containing at the most 10 carbon atoms, $R_1$ represents an alkyl radical containing at least 7 carbon atoms and $R_2$ is a member selected from the group consisting of hydrogen and alkyl. None of the alkylating agents cited contains an aromatic group i.e. benzyl chloride is apparently not included. The aromatic nucleus R may comprise substituents, for example, sulpho groups. The 2-substituent may also be a methoxy-, ethoxy-, mercapto- or thioalkyl-group. U.S. Pat. No. 2,053,822 further discloses that new imidazoles are characterized by the atom grouping

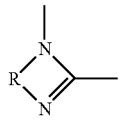

wherein the radical R represents a sulphonated aromatic radical, wherein further the nature of the μ-substituent follows from the above enumerations, and wherein at least one of the two nitrogen atoms is linked with a radical $R_1$. The examples disclose the reaction of dodecyl chloride, 2-chloroacetic acid dodecyl ester with μ-heptadecyl-benzimidazole followed by sulphonation.

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 3,704,130 discloses a method of preparing a photographic fine-grain silver halide emulsion, which comprises the step of precipitating the silver halide in an aqueous hydrophilic colloid medium in the presence of a compound corresponding to the following general formula:

Z-A-X, wherein: each of Z and X (the same or different) stands for a heterocycle or a heterocycle with fused-on ring, said heterocycle comprising the moiety ═N—, and A stands for a chemical bond, alkylene, alkylene interrupted by oxygen or —N(R)— wherein R=hydrogen or alkyl comprising at most 4 C-atoms, arylene, alkenylene, —S-alkylene-S— or —S-alkylene, the alkylene groups of which can be interrupted by oxygen or —N(R)— wherein R has the same significance as above; said compound being present in an amount sufficient to restrain growth of silver halide grains. U.S. Pat. No. 3,704,130 discloses the following 2-alkylthio-benzimidazole-6-sulphonic acid compounds as Compound 7:

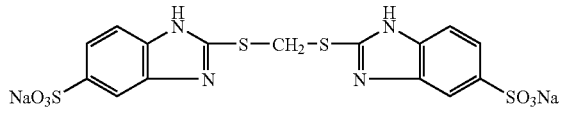

Compound 9:

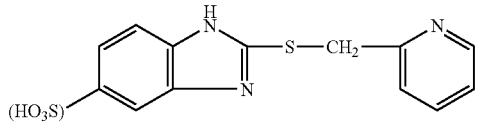

and Compound 10:

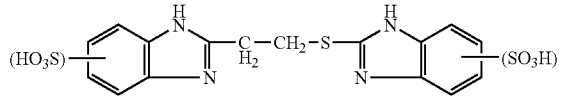

U.S. Pat. No. 4,639,408 discloses a process for forming an image comprising a heating step wherein a silver halide light-sensitive photographic material is heated in the presence of a compound represented by formula (I)

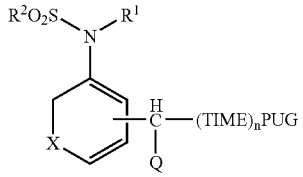

wherein X represents an atomic group completing a carbocyclic aromatic ring or a heterocyclic aromatic ring; $R^1$ is selected from selected from groups represented by formulae (A), (B), and (C):

$$—SO_2—R^{11} \quad (A)$$

$$—C(=O)—R^{11} \quad (B)$$

$$—P(=O)R^{11}R^{12} \quad (C)$$

in which $R^{11}$ and $R^{12}$ each represents a substituted or unsubstituted alkyl group, a cycloalkyl group, a substituted or unsubstituted aryl group, a substituted or unsubstituted heterocyclic group, an alkoxy or aryloxy group, an alkylthio or arylthio group, or a substituted or unsubstituted amino group, or $R^{11}$ and $R^{12}$ together form a 5-membered or 6-membered ring; $R^2$ represents a group selected from the groups represented by $R^{11}$; $R^1$ and $R^2$ together form a 5-membered or 6-membered ring; Q represents a hydrogen atom, an alkyl group, or an aryl group; TIME represents a timing group; PUG represents a photographically useful group; and n represents 0 or an integer, wherein the photographic material contains a base or a base precursor. U.S. Pat. No. 4,639,408 discloses the following 2-alkylthio-benzimidazole-6-sulphonic acid compounds as Compound (8):

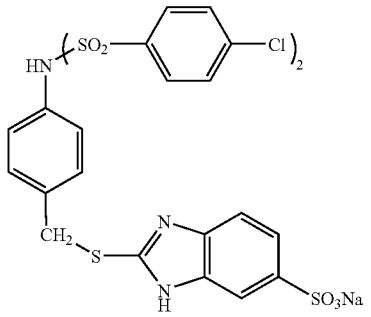

Compound (14):

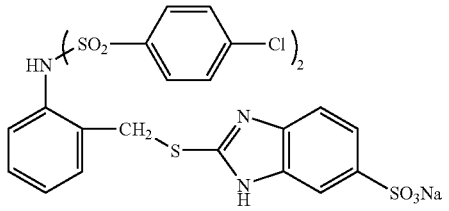

Compound (24):

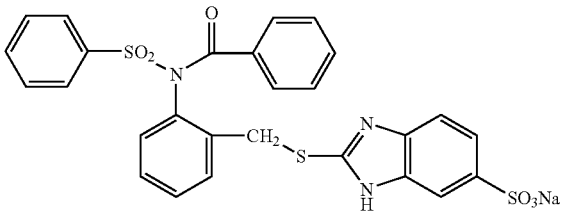

Compound 25:

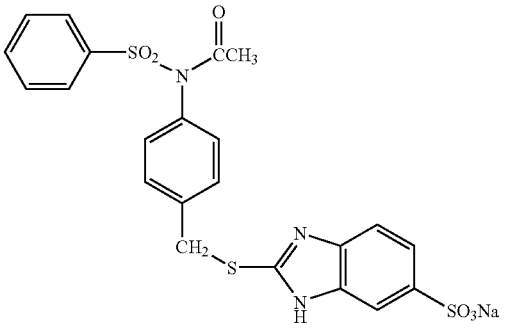

and Compound 29:

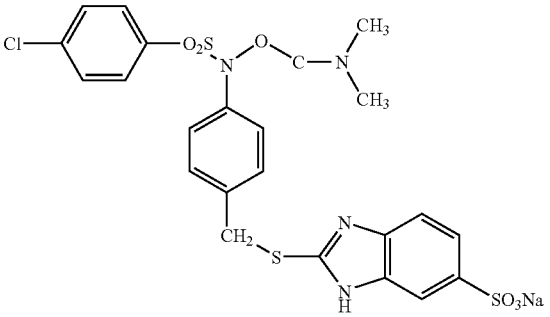

U.S. Pat. No. 3,901,769 discloses in an electrical recording member provided with a recording layer containing an image-forming agent, an electrically-conductive agent and a binder therefor, the improvement comprising said electrically-conductive agent comprising at least a porous compound containing therein a polar substance, wherein an image is formed on said layer by the application thereto of electrical current and discloses that the polar substance can be oleyl ($CH_3(CH_2)_7CH{=}CH(CH_2)_8$—) benzimidazole sulphonic acid.

Surfactants with excellent latex-stabilizing properties, which enhance the adhesion of hydrophilic layers to hydrophobic supports, such as polyethylene terephthalate and hydrophobic thermosensitive elements of substantially light-insensitive thermographic recording materials, which are photographically inactive, which do not contain photographically inactive impurities and which is compatible with image-wise heating with a thermal head when incorporated into the outermost layer of substantially light-insensitive thermographic recording materials.

ULTRAVON™ W, an anionic alkyl, benzyl-benzimidazole-sulfonic acid surfactant produced by Ciba, fulfils these requirements, except that being a mixture of at least 25 components it has variable properties and also often contains photographically active impurities, which have to be removed or rendered non-photographically active prior to use. Furthermore, it is no longer available.

ASPECTS OF THE INVENTION

It is therefore an aspect of the present invention to provide substantially light-insensitive thermographic recording materials containing alternative photographically inactive surfactants, which enhances the adhesion of hydrophilic layers to hydrophobic supports, has no photographically active impurities and is compatible with image-wise heating with a thermal head when incorporated into the outermost layer.

Further aspects and advantages of the invention will become apparent from the description hereinafter.

SUMMARY OF THE INVENTION

It has been surprisingly found that substantially light-insensitive monosheet thermographic recording material comprising a support and on one side of said support a thermosensitive element, wherein said thermographic recording material contains at least one compound represented by formula (I):

(I)

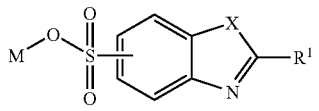

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; X is —O—, —S— or —N($R^2$)—; and $R^2$ is hydrogen, a —$(CH_2)_mSO_3M$ group or a

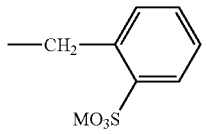

group; and m is an integer between 1 and 5; has comparable properties to ULTRAVON W while being synthesized by a more ecological process, having more consistent properties and without the necessity for removing photographically active impurities.

Aspects of the present invention are realized by a substantially light-insensitive monosheet thermographic recording material comprising a support and on one side of said support a thermosensitive element, wherein said thermographic recording material contains at least one compound represented by formula (I):

(I)

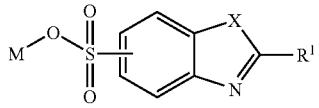

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; X is —O—, —S— or —N($R^2$)—; and $R^2$ is hydrogen, a —$(CH_2)_mSO_3M$ group or a

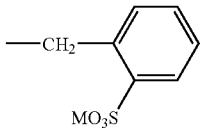

group; and m is an integer between 1 and 5.

Preferred embodiments of the present invention are disclosed in the detailed description of the invention.

DETAILED DESCRIPTION OF THE INVENTION

Definitions

The terms alkyl, alkenyl and alkynyl mean an aliphatic hydrocarbon group and all variants possible for each number of carbon atoms in the group i.e. the group can be a straight chain or a branched group. For example for a three carbon atom alkyl group: n-propyl and isopropyl; for a four carbon atom alkyl group: n-butyl, isobutyl and tertiary-butyl; for a five carbon atom alkyl group: n-pentyl, 1,1-dimethyl-propyl, 2,2-dimethylpropyl and 2-methyl-butyl. Branched alkyl groups with Guerbet groups are particularly suitable e.g. —$CH_2$—CH[—$(CH_2)_9$—$CH_3$]—$(CH_2)_{11}$—$CH_3$, —$CH_2$—CH[—$(CH_2)_8$—$CH_3$]—$(CH_2)_{10}$—$CH_3$, —$CH_2$—CH[—$(CH_2)_7$—$CH_3$]—$(CH_2)_9$—$CH_3$, —$CH_2$—CH[—$(CH_2)_6$—$CH_3$]—$(CH_2)_8$—$CH_3$, —$CH_2$—CH[—$(CH_2)_5$—$CH_3$]—$(CH_2)_7$—$CH_3$, —$CH_2$—CH[—$(CH_2)_4$—$CH_3$]—$(CH_2)_6$—$CH_3$ and —$CH_2$—CH[—$(CH_2)_3$—$CH_3$]—$(CH_2)_5$—$CH_3$.

The terms thioalkyl-, thioalkenyl- and thioalkynyl-group mean a group consisting of a sulphur atom bonded to an alkyl-, alkenyl- or alkynyl-group, which is bonded via the sulphur atom to the entity to which the group is bonded.

The term sulphoalkyl group means an alkyl group substituted with a sulphonic acid group.

The term "tautomeric with" means that the two compounds interchange rapidly with one another in a liquid or dissolved state.

The L*, a* and b* CIELAB-values are defined in ASTM Norm E179-90 in a R(45/0) geometry with evaluation according to ASTM Norm E308-90.

Substantially light-insensitive means not intentionally light sensitive.

The term substantially light-insensitive thermographic material includes all materials, which produce a change in optical density upon the application of heat.

The term thermosensitive element as used herein is that element which contains all the ingredients, which contribute to image formation upon application of heat.

The term "high contrast agent", which are sometimes identified as "co-developers" or "auxiliary developers", have as their main function an increase in the contrast of the material by reducing most or all of the reducible silver ions in the substantially light-insensitive silver salt of a carboxylic acid in the radiation-exposed areas e.g. acrylonitrile co-developers, hydrazide co-developers and isoxazole co-developers as disclosed in U.S. Pat. No. 6,352,819 herein incorporated by reference.

Heating in association with the expression a substantially water-free condition as used herein, means heating at a temperature of 80 to 400° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermographic Recording Material

According to a first embodiment of the thermographic recording material, according to the present invention, the thermographic recording material is a black and white thermographic recording material.

According to a second embodiment of the thermographic recording material, according to the present invention, the thermographic recording material is a monosheet thermographic recording material.

Benzimidazole-Sulphonic Acid Compounds

According to a third embodiment of the thermographic recording material, according to the present invention, said at least one compound represented by formula (I) is represented by formula (II):

(II)

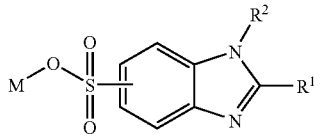

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; $R^2$ is hydrogen, a $—(CH_2)_mSO_3M$ group or a

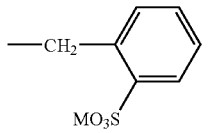

group; and m is an integer between 1 and 5.

The benzimidazole-sulphonic acid compounds represented by formula (II) include 2-alkyl-benzimidazole-sulphonic acid compounds and 2-thioalkyl-benzimidazole-sulphonic acid compounds.

According to a fourth embodiment of the thermographic recording material, according to the present invention, $R^1$ is a dodecyl, tridecyl, tetradecyl, pentadecyl, hexadecyl, heptadecyl or octadecyl group.

According to a fifth embodiment of the thermographic recording material, according to the present invention, $R^2$ is a $—(CH_2)_mSO_3M$ group.

Suitable 2-alkyl-benzimidazole-sulphonic acid compounds, according to the present invention, are:

| Compound nr | |
|---|---|
| 01 | 2-dodecyl,3-sulphobutyl-benzimidazole-6-sulphonic acid |
| 02 | 2-dodecyl,3-sulphobutyl-benzimidazole-6-sulphonic acid potassium salt |
| 03 | 2-dodecyl,3-sulphobutyl-benzimidazole-5-sulphonic acid |
| 04 | 2-dodecyl,3-sulphobutyl-benzimidazole-5-sulphonic acid potassium salt |
| 05 | 2-pentadecyl,3-sulphobutyl-benzimidazole-6-sulphonic acid |
| 06 | 2-pentadecyl,3-sulphobutyl-benzimidazole-6-sulphonic acid potassium salt |
| 07 | 2-pentadecyl,3-sulphobutyl-benzimidazole-5-sulphonic acid |
| 08 | 2-pentadecyl,3-sulphobutyl-benzimidazole-5-sulphonic acid potassium salt |
| 09 | 2-hexadecyl,3-sulphobutyl-benzimidazole-6-sulphonic acid |
| 10 | 2-hexadecyl,3-sulphobutyl-benzimidazole-6-sulphonic acid potassium salt |
| 11 | 2-hexadecyl,3-sulphobutyl-benzimidazole-5-sulphonic acid |
| 12 | 2-hexadecyl,3-sulphobutyl-benzimidazole-5-sulphonic acid potassium salt |
| 13 | 2-heptadecyl,3-sulphobutyl-benzimidazole-6-sulphonic acid |
| 14 | 2-heptadecyl,3-sulphobutyl-benzimidazole-6-sulphonic acid potassium salt |
| 15 | 2-heptadecyl,3-sulphobutyl-benzimidazole-5-sulphonic acid |
| 16 | 2-heptadecyl,3-sulphobutyl-benzimidazole-5-sulphonic acid potassium salt |
| 17 | 2-dodecyl-benzimidazole-6-sulphonic acid (tautomeric with 19) |
| 18 | 2-dodecyl-benzimidazole-6-sulphonic acid sodium salt (tautomeric with 20) |
| 19 | 2-dodecyl-benzimidazole-5-sulphonic acid (tautomeric with 17) |
| 20 | 2-dodecyl,5-sulpho-benzimidazole-5-sulphonic acid sodium salt (tautomeric with 18) |
| 21 | 2-pentadecyl-benzimidazole-6-sulphonic acid (tautomeric with 23) |
| 22 | 2-pentadecyl-benzimidazole-6-sulphonic acid sodium salt (tautomeric with 24) |
| 23 | 2-pentadecyl-benzimidazole-5-sulphonic acid (tautomeric with 21) |
| 24 | 2-pentadecyl-benzimidazole-5-sulphonic acid sodium salt (tautomeric with 22) |
| 25 | 2-hexadecyl-benzimidazole-6-sulphonic acid (tautomeric with 27) |
| 26 | 2-hexadecyl-benzimidazole-6-sulphonic acid sodium salt (tautomeric with 28) |
| 27 | 2-hexadecyl-benzimidazole-5-sulphonic acid (tautomeric with 25) |
| 28 | 2-hexadecyl-benzimidazole-5-sulphonic acid sodium salt tautomeric with 26) |
| 29 | 2-heptadecyl-benzimidazole-6-sulphonic acid (tautomeric with 31) |
| 30 | 2-heptadecyl-benzimidazole-6-sulphonic acid sodium salt (tautomeric with 32) |
| 31 | 2-heptadecyl-benzimidazole-5-sulphonic acid (tautomeric with 29) |

-continued

| Compound nr | |
|---|---|
| 32 | 2-heptadecyl-benzimidazole-5-sulphonic acid sodium salt (tautomeric with 30) |

According to a sixth embodiment of the thermographic recording material, according to the present invention, said at least one compound represented by formula (I) is at least one compound represented by formula (III):

(III)

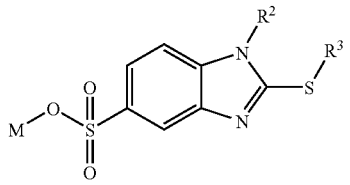

at least one compound represented by formula (IV):

(IV)

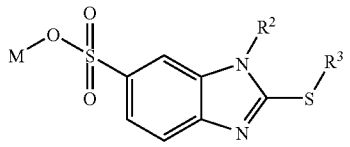

or a mixture of at least one compound represented by formula (III) with at least one compound represented by formula (IV), wherein M is hydrogen, an alkali atom or an ammonium group; $R^3$ is an alkyl, alkenyl or alkynyl group having 6 to 25 carbon atoms; $R^2$ is hydrogen, a $—(CH_2)_mSO_3M$ group or a

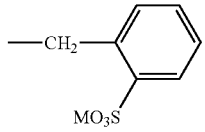

group; and m is an integer between 1 and 5.

According to a seventh embodiment of the thermographic recording material, according to the present invention, the at least one compound represented by formula (I) is represented by at least one compound represented by formula (III), at least one compound represented by formula (IV) or a mixture of at least one compound represented by formula (III) with at least one compound represented by formula (IV), $R^2$ is a $—(CH_2)_mSO_3M$ group and $R^3$ is an alkyl, alkenyl or alkynyl group having 12 to 24 carbon atoms.

According to an eighth embodiment of the thermographic recording material, according to the present invention, the at least one compound represented by formula (I) is represented by at least one compound represented by formula (III), at least one compound represented by formula (IV) or a mixture of at least one compound represented by formula (III) with at least one compound represented by formula (IV), $R^2$ is a $—(CH_2)_mSO_3M$ group and $R^3$ is an alkyl, alkenyl or alkynyl group having 12 to 16 carbon atoms.

According to a ninth embodiment of the thermographic recording material, according to the present invention, the at least one compound represented by formula (I) is represented by at least one compound represented by formula (III), at least one compound represented by formula (IV) or a mixture of at least one compound represented by formula (III) with at least one compound represented by formula (IV), $R^2$ is a $—(CH_2)_4SO_3M$ group and $R^3$ is an alkyl, alkenyl or alkynyl group having 12 to 24 carbon atoms.

According to a tenth embodiment of the thermographic recording material, according to the present invention, the at least one compound represented by formula (I) is represented by at least one compound represented by formula (III), at least one compound represented by formula (IV) or a mixture of at least one compound represented by formula (III) with at least one compound represented by formula (IV), $R^2$ is a $—(CH_2)_4SO_3M$ group and $R^3$ is an alkyl, alkenyl or alkynyl group having 12 to 16 carbon atoms.

Suitable 2-thioalkyl-benzimidazole-sulphonic acid compounds, according to the present invention, are:

| Compound nr | | |
|---|---|---|
| 33 | 2-thiodedecyl-benzimidazole-5-sulphonic acid(tautomeric with 03) | 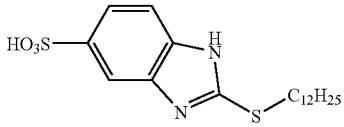 |
| 34 | 2-thiododecyl-benzimidazole-5-sulphonic acid sodium salt (tautomeric with 04) | |
| 35 | 2-thiododecyl-benzimidazole-6-sulphonic acid(tautomeric with 01) | |
| 36 | 2-thiododecyl-benzimidazole-6-sulphonic acid sodium salt (tautomeric with 02) | |

-continued

| Compound nr | |
|---|---|
| 37 | 2-thiopentadecyl-benzimidazole-5-sulphonic acid(tautomeric with 07) |
| 38 | 2-thiopentadecyl-benzimidazole-5-sulphonic acid sodium salt (tautomeric with 08) |
| 39 | 2-thiopentadecyl-benzimidazole-6-sulphonic acid(tautomeric with 05) |
| 40 | 2-thiopentadecyl-benzimidazole-6-sulphonic acid sodium salt (tautomeric with 06) |
| 41 | 2-thiohexadecyl-benzimidazole-5-sulphonic acid(tautomeric with 11) |
| 42 | 2-thiohexadecyl-benzimidazole-5-sulphonic acid sodium salt (tautomeric 12) |
| 43 | 2-thiohexadecyl-benzimidazole-6-sulphonic acid(tautomeric with 09) |
| 44 | 2-thiohexadecyl-benzimidazole-6-sulphonic acid sodium salt (tautomeric with 10) |
| 45 | 2-thioheptadecyl-benzimidazole-5-sulphonic acid(tautomeric with 15) |
| 46 | 2-thiopeptadecyl-benzimidazole-5-sulphonic acid sodium salt (tautomeric with 16) |
| 47 | 2-thioheptadecyl-benzimidazole-6-sulphonic acid(tautomeric with 13) |
| 48 | 2-thioheptadecyl-benzimidazole-6-sulphonic acid sodium salt (tautomeric with 14) |
| 49 | 2-thiododecyl, 3-sulphopentyl-benzimidazole-5-sulphonic acid |
| 50 | 2-thiododecyl, 3-sulphopentyl-benzimidazole-5-sulphonic acid sodium salt |
| 51 | 2-thiododecyl, 3-sulphopentyl-benzimidazole-6-sulphonic acid |
| 52 | 2-thiododecyl, 3-sulphopentyl-benzimidazole-6-sulphonic acid sodium salt |
| 53 | 2-thiopentadecyl, 3-sulphopentyl-benzimidazole-5-sulphonic acid |
| 54 | 2-thiopentadecyl, 3-sulphopentyl-benzimidazole-5-sulphonic acid potassium salt |
| 55 | 2-thiopentadecyl, 3-sulphopentyl-benzimidazole-6-sulphonic acid |
| 56 | 2-thiopentadecyl, 3-sulphopentyl-benzimidazole-6-sulphonic acid potassium salt |
| 57 | 2-thiohexadecyl, 3-sulphopentyl-benzimidazole-5-sulphonic acid |
| 58 | 2-thiohexadecyl, 3-sulphopentyl-benzimidazole-5-sulphonic acid potassium salt |
| 59 | 2-thiohexadecyl, 3-sulphopentyl-benzimidazole-6-sulphonic acid |
| 60 | 2-thiohexadecyl, 3-sulphopentyl-benzimidazole-6-sulphonic acid potassium salt |
| 61 | 2-thioheptadecyl, 3-sulphopentyl-benzimidazole-5-sulphonic acid |
| 62 | 2-thioheptadecyl, 3-sulphopentyl-benzimidazole-5-sulphonic acid potassium salt |

-continued

| Compound nr | |
|---|---|
| 63 | 2-thioheptadecyl, 3-sulphopentyl-benzimidazole-6-sulphonic acid |
| 64 | 2-thioheptadecyl, 3-sulphopentyl-benzimidazole-6-sulphonic acid potassium salt |
| 65 | 2-thiododecyl, 3-sulphobutyl-benzimidazole-5-sulphonic acid |
| 66 | 2-thiododecyl, 3-sulphobutyl-benzimidazole-5-sulphonic acid potassium salt |
| 67 | 2-thiododecyl, 3-sulphobutyl-benzimidazole-6-sulphonic acid |
| 68 | 2-thiododecyl, 3-sulphobutyl-benzimidazole-6-sulphonic acid sodium salt |
| 69 | 2-thiododecyl, 3-sulphobutyl-benzimidazole-6-sulphonic acid potassium salt |
| 70 | 2-thiopentadecyl, 3-sulphobutyl-benzimidazole-5-sulphonic acid |
| 71 | 2-thiopentadecyl, 3-sulphobutyl-benzimidazole-5-sulphonic acid potassium salt |
| 72 | 2-thiopentadecyl, 3-sulphobutyl-benzimidazole-6-sulphonic acid |
| 73 | 2-thiopentadecyl, 3-sulphobutyl-benzimidazole-6-sulphonic acid potassium salt |
| 74 | 2-thiohexadecyl, 3-sulpho-butyl-benzimidazole-5-sulphonic acid |
| 75 | 2-thiohexadecyl, 3-sulphobutyl-benzimidazole-5-sulphonic acid sodium salt |
| 76 | 2-thiohexadecyl, 3-sulpho-butyl-benzimidazole-5-sulphonic acid potassium salt |
| 77 | 2-thiohexadecyl, 3-sulphobutyl-benzimidazole-6-sulphonic acid |

-continued

| Compound nr | | |
|---|---|---|
| 78 | 2-thiohexadecyl, 3-sulphobutyl-benzimidazole-6-sulphonic acid sodium salt | 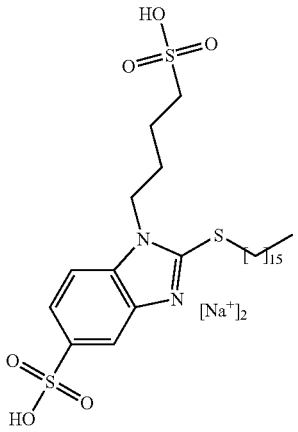 |
| 79 | 2-thiohexadecyl, 3-sulphobutyl-benzimidazole-6-sulphonic acid potassium salt | |
| 80 | 2-thioheptadecyl, 3-sulpho-butyl-benzimidazole-5-sulphonic acid | |
| 81 | 2-thioheptadecyl, 3-sulphobutyl-benzimidazole-5-sulphonic acid sodium salt | |
| 82 | 2-thioheptadecyl, 3-sulpho-butyl-benzimidazole-5-sulphonic acid potassium salt | |
| 83 | 2-thioheptadecyl, 3-sulpho-butyl-benzimidazole-6-sulphonic acid | |
| 84 | 2-thioheptadecyl, 3-sulphobutyl-benzimidazole-6-sulphonic acid potassium salt | |
| 85 | 2-thiododecyl, 3-sulphopropyl-benzimidazole-5-sulphonic acid | |
| 86 | 2-thiododecyl, 3-sulphopropyl-benzimidazole-5-sulphonic acid sodium salt | |
| 87 | 2-thiododecyl, 3-sulphopropyl-benzimidazole-5-sulphonic acid potassium salt | |
| 88 | 2-thiododecyl, 3-sulphopropyl-benzimidazole-6-sulphonic acid | |
| 89 | 2-thiododecyl, 3-sulphopropyl-benzimidazole-6-sulphonic acid potassium salt | |
| 90 | 2-thiododecyl, 3-sulphopropyl-benzimidazole-6-sulphonic acid sodium salt | |
| 91 | 2-thiopentadecyl, 3-sulpho-propyl-benzimidazole-5-sulphonic acid | |
| 92 | 2-thiopentadecyl, 3-sulphopropyl-benzimidazole-5-sulphonic acid potassium salt | |
| 93 | 2-thiopentadecyl, 3-sulpho-propyl-benzimidazole-6-sulphonic acid | |
| 94 | 2-thiopentadecyl, 3-sulpho-propyl-benzimidazole-6-sulphonic acid potassium salt | |
| 95 | 2-thiohexdecyl, 3-sulpho-propyl-benzimidazole-5-sulphonic acid | |
| 96 | 2-thiohexadecyl, 3-sulphopropyl-benzimidazole-5-sulphonic acid potassium salt | |
| 97 | 2-thiohexadecyl, 3-sulphopropyl-benzimidazole-5-sulphonic acid sodium salt | |

-continued

| Compound nr | |
|---|---|
| 98 | 2-thiohexadecyl, 3-sulphopropyl-benzimidazole-6-sulphonic acid |
| 99 | 2-thiohexadecyl, 3-sulphopropyl-benzimidazole-6-sulphonic acid potassium salt |
| 100 | 2-thioheptadecyl, 3-sulpho-propyl-benzimidazole-5-sulphonic acid |
| 101 | 2-thioheptadecyl, 3-sulphopropyl-benzimidazole-5-sulphonic acid potassium salt |
| 102 | 2-thioheptadecyl, 3-sulpho-propyl-benzimidazole-6-sulphonic acid |
| 103 | 2-thioheptadecyl, 3-sulphopropyl-benzimidazole-6-sulphonic acid potassium salt |
| 104 | 2-thiododecyl, 3-sulphoethyl-benzimidazole-5-sulphonic acid |
| 105 | 2-thiododecyl, 3-sulphoethyl-benzimidazole-5-sulphonic acid potassium salt |
| 106 | 2-thiododecyl, 3-sulphoethyl-benzimidazole-6-sulphonic acid |
| 107 | 2-thiododecyl, 3-sulphoethyl-benzimidazole-6-sulphonic acid potassium salt |
| 108 | 2-thiopentadecyl, 3-sulpho-ethyl-benzimidazole-5-sulphonic acid |
| 109 | 2-thiopentadecyl, 3-sulphoethyl-benzimidazole-5-sulphonic acid potassium salt |
| 110 | 2-thiopentadecyl, 3-sulpho-ethyl-benzimidazole-6-sulphonic acid |
| 111 | 2-thiopentadecyl, 3-sulphoethyl-benzimidazole-6-sulphonic acid potassium salt |
| 112 | 2-thiohexadecyl, 3-sulpho-ethyl-benzimidazole-5-sulphonic acid |
| 113 | 2-thiohexadecyl, 3-sulphoethyl-benzimidazole-6-sulphonic acid |
| 114 | 2-thiohexadecyl, 3-sulphoethyl-benzimidazole-6-sulphonic acid potassium salt |
| 115 | 2-thioheptadecyl, 3-sulpho-ethyl-benzimidazole-5-sulphonic acid |
| 116 | 2-thioheptadecyl, 3-sulphoethyl-benzimidazole-5-sulphonic acid potassium salt |
| 117 | 2-thioheptadecyl, 3-sulpho-ethyl-benzimidazole-6-sulphonic acid |
| 118 | 2-thioheptadeycl, 3-sulphoethyl-benzimidazole-6-sulphonic acid potassium salt |

—$(CH_2)_mSO_3M$ group and

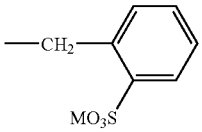

groups can be incorporated into 2-alkyl- or 2-thioalkyl-benzimidazole-sulphonic acids by reaction with alkanesultones, such as 1,4-butanesultone and 1,3-propanesultone, and 3H-2,1-benzothiazole, 1,1-dioxide α-hydroxy-o-toluenesulfonic acid-γ-sultone or o-tolyl sultone) respectively.

A 1:1 mixture of Compound 75 and Compound 78 (SURF 09) is an excellent post-polymerization stabilizer for latexes e.g. a terpolymer latex of vinylidene chloride/methyl acrylate/itaconic acid (88/10/2 by weight).

Thermosensitive Element

The term thermosensitive element as used herein is that element which contains all the ingredients, which contribute to image formation upon application of heat. These ingredients constitute an image-forming system. Suitable image-forming systems include monosheet substantially light-insensitive thermographic materials such as colourless or light coloured dye precursor leuco-dye systems, as disclosed in U.S. Pat. No. 4,370,370, EP-A 479 578 and EP-A 754 564, diazo systems, as disclosed in JP 60-01077A.

Alternatively the image-forming systems may comprise at least one substantially light-insensitive organic silver salt and at least one organic reducing agent therefor in a monosheet material in which the at least one substantially light-insensitive organic silver salt is in thermal working relationship with the at least one organic reducing agent therefor. The thermosensitive element may comprise a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of the substantially light-insensitive silver salt of a carboxylic acid, so that reduction to silver can occur. Such materials include the possibility of the substantially light-insensitive organic silver salt and/or the reducing agent therefor being encapsulated in heat-responsive microcapsules, such as disclosed in EP-A 0 736 799 herein incorporated by reference.

Substantially Light-Insensitive Organic Silver Salt

According to an eleventh embodiment of the thermographic recording material, according to the present invention, the substantially light-insensitive organic silver salt is not a double salt containing a silver cation associated with a second cation e.g. magnesium or iron ions.

According to a twelfth embodiment, according to the present invention, the thermosensitive element comprises at least one substantially light-insensitive silver salt of a carboxylic acid, at least one reducing agent therefor in thermal working relationship therewith and at least one binder.

According to a thirteenth embodiment of the thermographic recording material, according to the present invention, the substantially light-insensitive organic silver salt is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salts of an organic carboxylic acids may also be used in the present invention, as disclosed in EP-A 964 300 herein incorporated by reference.

Reducing Agent

According to a fourteenth embodiment of thermographic recording material, according to the present invention, the reducing agent is an ortho-dihydroxy-benzene derivative.

According to a fifteenth embodiment of the thermographic recording material, according to the present invention, the ortho-dihydroxy-benzene derivative is selected from the group consisting of catechol, 3-(3,4-dihydroxyphenyl) propionic acid, 3,4-dihydroxybenzoic acid, 3,4-dihydroxybenzoic acid esters, gallic acid, gallic acid esters, e.g. methyl gallate, ethyl gallate and propyl gallate, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid, as disclosed in EP-A 0 692 733, EP-A 0 903 625, EP-A 1 245 403 and EP-A 1 245 404 herein incorporated by reference.

Combinations of reducing agents may also be used that on heating become reactive partners in the reduction of the one or more substantially light-insensitive organic silver salt. For example, combinations of sterically hindered phenols with sulphonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. Nos. 5,635,339; and 2-substituted malonodialdehyde compounds as disclosed in U.S. Pat. No. 5,654,130.

Binder

The thermosensitive element of the substantially light-insensitive elongated imaging material used in the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders include: polyvinyl alcohol, polyacrylamide, polymethacrylamide, polyacrylic acid, polymethacrylic acid, polyethyleneglycol, polyvinylpyrrolidone, proteinaceous binders such as gelatin and modified gelatins, such as phthaloyl gelatin, polysaccharides, such as starch, gum arabic and dextrin, and water-soluble cellulose derivatives. Suitable water-dispersible binders are any water-insoluble polymers. Poly(vinyl butyral) is the preferred binder.

In the case of substantially light-insensitive thermographic materials containing substantially light-insensitive organic silver salts, the binder to organic silver salt weight ratio decreases the gradation of the image increasing. Binder to organic silver salt weight ratios of 0.2 to 6 are preferred with weight ratios between 0.5 and 4.5 being particularly preferred.

The above mentioned binders or mixtures thereof may be used in conjunction with waxes or "heat solvents" to improve the reaction speed of the image-forming reaction at elevated temperatures.

Binders are preferred which do not contain additives, such as certain antioxidants (e.g. 2,6-di-tert-butyl-4-methylphenol), or impurities, which adversely affect the thermographic properties of the thermographic recording materials in which they are used.

Toning Agent

According to a sixteenth embodiment of the thermographic recording material, according to the present invention, the thermosensitive element further contains at least one toning agent.

According to a seventeenth embodiment of the thermographic recording material, according to the present invention, the at least one toning agent is selected from the group consisting of phthalazinone, phthalazinone derivatives, benzoxazine dione, benzoxazine dione derivatives, naphthoxazine dione and naphthoxazine dione derivatives, pyridazone and pyridazone derivatives.

Protective Layer

According to an eighteenth embodiment of the thermographic recording material, according to the present invention, the thermosensitive element is provided with an outermost protective layer.

According to a nineteenth embodiment of the thermographic recording material, according to the present invention, the thermosensitive element is provided with an outermost protective layer containing at least one compound represented by formula (I).

In general the outermost protective layer protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface-active agent, a liquid lubricant, a solid lubricant or mixtures thereof, with or without a polymeric binder.

According to a twentieth embodiment of the thermographic recording material, according to the present invention, the thermosensitive element is provided with an outermost protective layer comprising the reaction product of at least one hydrolyzed polyalkoxysilane and a hydroxy-group containing polymer.

According to a twenty-first embodiment of the thermographic recording material, according to the present invention, the thermosensitive element is provided with an outermost protective layer comprising the reaction product of hydrolyzed tetramethoxysilane or tetra-ethoxysilane and a hydroxy-group containing polymer.

According to a twenty-second embodiment of the thermographic recording material, according to the present invention, the thermosensitive element is provided with an outermost protective layer comprising the reaction product of at least one hydrolyzed polyalkoxysilane and polyvinyl alcohol.

Stabilizers

According to a twenty-third embodiment of the substantially light-insensitive monosheet thermographic recording material, according to the present invention, the thermosensitive element further contains a stabilizer.

According to a twenty-fourth embodiment of the substantially light-insensitive monosheet thermographic recording material, according to the present invention, the thermosensitive element further contains a stabilizer selected from the group consisting of benzotriazole; substituted benzotriazoles; aromatic polycarboxylic acid, such as ortho-phthalic acid, 3-nitro-phthalic acid, tetrachlorophthalic acid, mellitic acid, pyromellitic acid and trimellitic acid and anhydrides thereof.

According to a twenty-fifth embodiment of the substantially light-insensitive monosheet thermographic recording material, according to the present invention, the thermosensitive element further contains at least one optionally substituted aliphatic or carbocyclic polycarboxylic acid and/or anhydride thereof in a molar percentage of at least 15 with respect to all the organic silver salt(s) present and in thermal working relationship therewith. The polycarboxylic acid may be used in anhydride form or partially esterified on the condition that at least two free carboxylic acids remain or are available during the heat recording step.

Surfactants and Dispersants

Surfactants and dispersants aid the dispersion of ingredients, which are insoluble in the particular dispersion medium. The substantially light-insensitive thermographic recording material used in the present invention may contain one or more additional surfactants, which may be anionic, non-ionic or cationic surfactants and/or one or more dispersants.

Suitable dispersants are natural polymeric substances, synthetic polymeric substances and finely divided powders, e.g. finely divided non-metallic inorganic powders such as silica.

Support

According to a twenty-sixth embodiment of the substantially light-insensitive monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Subbing Layers and Subbing Layer Systems

According to a twenty-seventh embodiment of the thermographic recording material, according to the present invention, said support is provided with a subbing layer or subbing layer system on at least one side of said support.

According to a twenty-eighth embodiment of the thermographic recording material, according to the present invention, said support is provided with a subbing layer or subbing layer system on at least one side of said support and said subbing layer or at least one layer of said subbing layer system contains at least one compound represented by said formula (I).

The term subbing layer system refers to more than one layer fulfilling the function of subbing, subbing meaning provision of a means of providing adhesion of a functional layer to a support. For example, in photographic materials a combination of two layers is often used to provide adhesion of a photographic silver halide and gelatin-containing emulsion layer to a poly(ethylene terephthalate) support, the layer adjacent to the poly(ethylene terephthalate) support often comprising a polymer latex, e.g. a terpolymer latex of vinylidene chloride/methyl acrylate/itaconic acid (88/10/2 by weight), colloidal silica and anionic surfactants, and the second layer in the subbing layer system often comprising gelatin, colloidal silica and anionic surfactants.

According to a twenty-ninth embodiment of the thermographic recording material, according to the present invention, said support is provided with a subbing layer or subbing layer system on at least one side of said support and said subbing layer or all layers of said subbing layer system contain(s) at least one compound represented by said formula (I). This is not only because of the thermographically inert nature of compounds represented by formula (I) and the absence of thermographically active impurities, but also because of the improved wettability of subbing layers and of the outermost layer of subbing layer systems resulting in improved overcoatability and faster coating compared with alternative surfactants such as Ultravon™ W from Ciba-Geigy.

Preferred additional ingredients for the subbing layer used in accordance with the present invention are a polymer latex, polyethylene wax and hydrolyzed polyalkoxysilanes. By the term polyalkoxysilane is meant a silane with a least two hydrolyzable alkoxy-groups. Particularly preferred polymer latexes for use in the subbing layer of the present invention are producible with monomers selected from the group consisting of acrylates, methacrylates, vinyl esters, acrylic acid, methacrylic acid, itaconic acid, vinylidene chloride, polyisocyanates, aromatic polycarboxylic acids and polyols.

Suitable additional ingredients for use in the subbing layer of the photographic material, according to the present invention, are:

- 3-glycidoxypropyltrimethoxysilane hydrolyzed in the presence of polystyrene sulfonic acid;
- a copolymer consisting of 80% by weight of ethyl acrylate and 20% by weight of methacrylic acid;
- a copolyester consisting of 26.5 mol % of terephthalic acid, 20 mol % of isophthalic acid, 3.5 mol % of sulfo-isophthalic acid and 50 mol % of ethylene glycol;
- a terpolymer latex of vinylidene chloride/methyl acrylate/itaconic acid (88/10/2 by weight);
- gelatin e.g. K 18435, a calcium-free medium viscosity gelatin from DFG STOESS;
- polyethylene wax e.g. HORDAMER™ PE02: a 40% aqueous dispersion of polyethylene from HOECHST and MOBILCER™ Q, a microcrystalline polyethylene wax from Mobil Oil;
- melamine-formaldehyde resin e.g. PAREZ RESIN™ 707, a 80% solids melamine-formaldehyde resin from AMERICAN CYANAMID;
- polymethylmethacrylate particles; and
- silica e.g. KIESELSOL 100F and 300F, 30% aqueous dispersions of colloidal silica from BAYER, and
- additional non-ionic and anionic surfactants.

Backing Layer

The thermosensitive element of the present invention may further comprise an outermost layer at the other side of the support. This layer is referred to as the backing layer. Typical backing layers comprise a binder and a matting agent. Said binder may be hydrophobic or hydrophilic. Hydrophobic binders may be coated from an organic solvent solution or dispersion or from a dispersion in water. Preferred hydrophobic binders include cellulose derivatives such as i.e. cellulose acetate butyrate or poly(methyl methacrylate).

It is particularly preferred to use a hydrophilic binder for the backing layer, since this may reduce the curl of the film if the relative humidity changes. Preferred hydrophilic binders are polyvinylalcohol, water soluble cellulose ester such as hydroxy ethyl cellulose, gelatin or the like, of which polyvinylalcohol is particularly preferred.

Colloidal fillers such as silica, clay, aluminium oxide, aluminium hydroxide may also be added to the backing layer to enhance the film curl or water resistance of the backing layer. Typically, a binder/filler ration of 10/90 to 90/10 is used, more preferably 30/70 to 70/30. A particularly preferred binder/filler combination is polyvinylalcohol/colloidal silica in a ratio of 40/60.

The backing layer may further contain a matting agent. Polymeric or inorganic matting agents may be used as matting agents e.g. poly(methyl methacrylate) or polystyrene beads, silica, clay, calcined clay. The matting agent is preferably spherical and may be coated with waxes, fatty acids, fatty acid esters or silicone in order to reduce clogging and friction coefficient. Particularly preferred are spherical silica beads having an average particle diameter of 2 to 10 μm.

In order to prevent the thermal head from being soiled in the event that film sheets are placed in the cassette such that the thermal head comes into contact with the backing layer during the printing process, lubricants and/or thermal head cleaning pigments such as disclosed in EP-A 0 669 875, EP-A 0 669 876, EP-A 0 775 592 and EP-A 0 775 595, may be incorporated into the backing layer. The lubricants avoid transport problems in the printer, while the cleaning pigments clean the head while printing. Suitable lubricants include waxes, silicones, fluoro-surfactants and phosphoric acid derivatives with phosphoric acid derivatives and more specifically phosphoric acid esters being particularly preferred. Typical thermal head cleaning pigments are talc, silica (amorphous or crystalline), clay, calcined clay, aluminiumoxide, aluminiumhydroxide, titaniumoxide, with silica and calcined china clay being particularly preferred.

The backing layer may further contain coating additives such as wetting and levelling agents e.g. surfactants according to the present invention and ethoxylated alkyl phenyl surfactants (anionic or non-ionic).

Typical formulations for backing layers with a hydrophilic binder used in the thermographic recording material of the present invention are:

| | |
|---|---|
| CELVOL ™ 103, a polyvinylalcohol from Celanese, as binder: | 2000 mg/m$^2$ |
| SNOWTEX ™ O, a colloidal silica from Nissan: | 3000 mg/m$^2$ |
| or | |
| LEVASIL ™ 200E, a colloidal silica from H. C. Starck (calculated as solids after drying), as colloidal fillers: | 3000 mg/m$^2$ |
| SUNPHERE ™ H51 from Asahi Glass, as matting agent: | 30 mg/m$^2$ |
| SATINTONE ™ 5, a calcined china clay from Engelhard: | 100 mg/m$^2$ |
| or | |
| SYLOID ™ 72 from Grace, as cleaning pigments: | 60 mg/m$^2$ |
| SERVOXYL ™ VPDZ 3 100, a phosphoric acid ester from SERVO DELDEN, as lubricant: | 100 mg/m$^2$ |
| AKYPO ™ OP-80 from UNIVAR Benelux as surfactant | 50 mg/m$^2$ |

Coating Techniques

The coating of any layer of the substantially light-insensitive thermographic recording material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic recording material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulse-wise. EP-A 622 217 discloses a method for making an image using a direct thermal imaging element producing improvements in continuous tone reproduction. Image-wise heating of the recording material can also be carried out using an electrically resistive ribbon incorporated into the material. Image- or pattern-wise heating of the recording material may also proceed by means of pixel-wise modulated ultra-sound.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

General Synthesis Route (i) for Tautomeric Mixtures of Compounds 17 and 19, 21 and 23, 25 and 27, 29 and 31 Etc o-phenylene diamine was reacted in the melt with the corresponding fatty acid, e.g. palmitic acid in the case of Compound 21, to the corresponding 2-alkyl-benzimidazole. The 2-alkyl-benzimidazole was then reacted with chlorosulphonic acid to produce a tautomeric mixture of the 2-alkyl-benzimidazole-6-sulphonic acid and the 2-alkyl-benzimidazole-5-sulphonic acid.

General Synthesis Route (ii) for Tautomeric Mixtures of Compounds 17 and 19, 21 and 23, 25 and 27, 29 and 31 Etc 3-amino-2-nitro-benzenesulphonic acid was reduced by catalytic hydrogenation to 2,3-diamino-benzenesulphonic acid, which was then reacted with the corresponding fatty acid, e.g. palmitic acid in the case of Compound 21, in a mixture of polyphosphoric acid and dimethyl acetamide to a tautomeric mixture of 2-alkyl-benzimid-azole-5-sulphonic acid and 2-alkyl-benzimidazole-6-sulphonic acid.

General Synthesis Route for Mixtures of Compounds 02 and 04, 06 and 08, 10 and 12, 14 and 16 Etc The mixture of the structural isomers 2-alkyl-benzimidazole-6-sulphonic acid and 2-alkyl-benzimidazole-5-sulphonic acid was then reacted with butanesultone in the presence of potassium hydroxide to produce the structural isomers: 2-alkyl, 3-sulphobutyl-benzimidazole-5-sulphonic acid and 2-alkyl, 3-sulphobutyl-benzimidazole-6-sulphonic acid.

General Synthesis Route for Compounds 34, 38, 42, 46 Etc

The sodium salt of 2-mercapto-benzimidazole-5-sulphonic acid was S-alkylated in the presence of DIPEA as base in dimethyl acetamide by reaction with the corresponding alkyl bromide by stirring overnight at 52° C. In this way alkylation could be carried out selectively at the mercapto-group and could be suppressed at the 1-position. A yield of up to 96% of compound 42 was obtained in the case of cetyl bromide.

Synthesis of Compound 42

1728 g of the monosodium salt of 2-mercapto-benzimidazole-5-sulphonic acid and 3150 mL of dimethyl acetamide were added to a 10 liter vessel provided with a compressed air stirrer, a dropping funnel and a reflux condenser was placed in an oil bath. 1359 mL of DIPEA were then added to this heterogeneous mixture with stirring and the light-brown suspension heated to 40° C. 2382 g of cetyl bromide was added dropwise and the mixture heated to 52° C. There was no increase in temperature during this step. The reaction was carried out with stirring at 52° C. for 20 hours after which the reaction was virtually complete. The mixture was then transferred to a 20 liter vessel, cooled to room temperature and 6 L of acetone was added with stirring and the stirring continued for 1 hour after the addition was completed. A thick suspension was obtained, which is relatively difficult to stir. The product was then filtered off, twice washed with 800 mL of a 1:2 mixture of dimethyl acetamide/acetone, twice washed with 1400 mL of a 1:3 mixture of dimethyl acetamide/acetone, washed four times with 1200 mL of acetone and finally dried in a forced air drying cupboard at 45° C. for 2 days. 2.53 kg of Compound 42 (sodium salt of 2-thiohexadecyl-benzimidazole-5-sulphonic acid) was obtained corresponding to a yield of 89% and contained 4 mol % of dimethyl acetamide and 7 mol % of DIPEA.

Synthesis of a Mixture of the Structural Isomers Compound 75 and Compound 78

1190 g of Compound 42 (sodium salt of 2-thiohexadecyl-benzimidazole-5-sulphonic acid) and 3890 mL of dimethyl acetamide were added to a 10 liter vessel provided with a compressed air stirrer, a dropping funnel and a reflux condenser was placed in an oil bath. 103.9 g of 97% sodium hydroxide were then added with stirring and the mixture heated to 80° C. The heat source was then removed and 252.4 mL of butanesultone added over a period of 5 minutes, whereupon the temperature increased to 94° C. After addition of a third of this quantity of butanesultone a white precipitate is formed and the mixture becomes more difficult to stir after addition was completed. The reaction mixture was then cooled to 50° C. and 5170 mL of acetone added with stirring. The product precipitates out and the suspension becomes more difficult to stir. The product was then filtered off, washed with 2 L of a 1:3 mixture of dimethyl acetamide/acetone, stirred with 14 L of a 1:3 mixture of dimethyl acetamide/acetone, filtered again, twice washed with 4 L of a 1:3 mixture of dimethyl acetamide/acetone, washed 6 times with 2 L of acetone and then dried to constant weight in a forced air drying cupboard at 45° C. The product a mixture of the structural isomers: Compound 75 (2-thiohexadecyl, 3-sulphobutyl-benzimidazole-5-sulphonic acid sodium salt) and Compound 78 (2-thiohexadecyl, 3-sulphobutyl-benzimidazole-6-sulphonic acid sodium salt) was obtained in a yield of 95%.

Separation of Compound 75 (2-thiohexadecyl, 3-sulphobutyl-benzimidazole-5-sulphonic acid sodium salt) and Compound 78 (2-thiohexadecyl, 3-sulphobutyl-benzimidazole-6-sulphonic acid sodium salt) could be realized by working up the product before adding acetone to the reaction mixture. After filtration, washing and treatment with warm dimethyl acetamide almost pure Compound 75 (2-thiohexadecyl, 3-sulphobutyl-benzimidazole-5-sulphonic acid sodium salt) was isolated. The second structural isomer, Compound 78 (2-thiohexadecyl, 3-sulphobutyl-benzimidazole-6-sulphonic acid sodium salt) was extracted from the filtrate by adding acetone.

Other Ingredients Used in Stabilization and Overcoatability Examples

| | |
|---|---|
| ULTRAVON W = | a sodium arylsulfonate surfactant from Ciba-Geigy |
| ARKOPON T = | a 40% concentrate of a sodium salt of N-methyl-N-2-sulfo-ethyl-oleylamide from CLARIANT |
| ARKOPAL ™ N060 = | a nonylphenylpolyethylene-glycol from CLARIANT |
| NIAPROOF ANIONIC ™ 4 = | a 27% concentrate of a sodium 1-(2'-ethylbutyl)-4-ethylhexylsulphate from NIACET |
| FLUORAD ™ FX1005 = | ammonium salt of perfluoro-octanoic acid from 3 M |
| SURF 09 = | a 1:1 mixture of Compound 75 and Compound 78 |
| K 18114 = | a gelating from DGF Stoess |
| antihalo dye = | 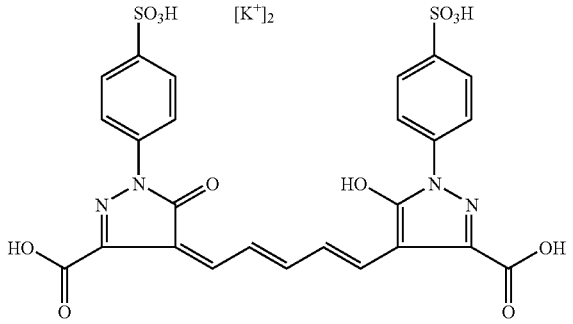 |

Composition of Thermosensitive Elements:

| | Thermosensitive element types | | |
|---|---|---|---|
| | 1 | 2 | 3 |
| AgBeh [g/m$^2$] | 4.07 | 4.15 | 4.15 |
| BL5HP [g/m$^2$] | 16.29 | 16.596 | 16.596 |
| Binder/AgBeh by weight | 4.0 | 4.0 | 4.0 |
| R01 [mol % vs AgBeh] | — | 35 | 50 |
| R02 [mol % vs AgBeh] | — | 45 | 30 |
| R03 [mol % vs AgBeh] | 50 | — | — |
| T01 [mol % vs AgBeh] | 15 | — | — |
| T02 [mol % vs AgBeh] | 5 | | 4.99 |

-continued

| | Thermosensitive element types | | |
|---|---|---|---|
| | 1 | 2 | 3 |
| T03 [mol % vs AgBeh] | — | 15 | 10 |
| S01 [mol % vs AgBeh] | 5 | 4.91 | 4.91 |
| S02 [mol % vs AgBeh] | 10 | 9.84 | 9.84 |
| S03 [mol % vs AgBeh] | 24 | 24 | 22 |
| VL [g/m$^2$] | — | 0.185 | 0.185 |
| Oil [g/m$^2$] | 0.036 | 0.037 | 0.037 |

Ingredients in the Thermosensitive Element in Addition to the Above-Mentioned Ingredients

| | |
|---|---|
| BL5HP = | S-LEC ™ BL5HP, a poly(vinyl butyral) from SEKISUI |
| Oil = | BAYSILON, a silicone oil from BAYER; |
| VL = | DESMODUR VL, a 4,4'-diisocyanatodiphenylmethane from BAYER |

Reducing Agents:

| | |
|---|---|
| R01 = | 3,4-dihydroxybenzonitrile; |
| R02 = | 3,4-dihydroxybenzophenone; |
| R03 = | 3,4-dihydroxybenzoic acid ethyl ester |

Toning Agents:

| | |
|---|---|
| T01 = | benzo[e][1,3]oxazine-2,4-dione |
| T02 = | 7-ethyl-carbonato-benzo[e][1,3]oxazine-2,4-dione |
| T03 = | 7-methyl-benzo[e][1,3]oxazine-2,4-dione |

Stabilizers:

| | |
|---|---|
| S01 = | glutaric acid |
| S02 = | tetrachlorophthalic acid anhydride |
| S03 = | benzotriazole |

Ingredients in the Protective Layer:

| | |
|---|---|
| ERKOL ™ 48 20 = | a polyvinylalcohol from ACETEX EUROPE; |
| LEVASIL ™ VP AC 4055 = | a 15% aqueous dispersion of colloidal silica with acid groups predominantly neutralized with sodium ions and a specific surface of 500 m$^2$/g from BAYER AG converted into its ammonium salt; |
| acid form of ULTRAVON ™ W = | 75–85% concentrate of a sodium arylsulphonate from Ciba Geigy converted into acid form by passing through an ion exchange column; |
| SURF 01 = | tautomeric mixture of Compound 05 and Compound 07* |
| SURF 02 = | Compound 35* |
| SURF 03 = | a 1:1.16 mixture of Compound 65 and Compound 67* |
| SURF 04 = | Compound 74* |
| SURF 05 = | Compound 77* |
| SURF 06 = | a 1:1 mixture of Compound 74 and Compound 77* |
| SURF 07 = | a 1:1 mixture of Compound 74 and Compound 77* |
| SURF 08 = | a 1:1 mixture of Compound 74 and Compound 77* |
| SYLOID ™ 72 = | a silica from Grace; |
| SERVOXYL ™ VPDZ 3/100 = | a mono[isotridecyl polyglycolether (3 EO)] phosphate, from SERVO DELDEN B.V.; |
| SERVOXYL ™ VPAZ 100 = | a mixture of monolauryl and dilauryl phosphate, from SERVO DELDEN B. V.; |
| MICROACE TALC P3 = | an Indian talc from NIPPON TALC; |
| SATINTONE ™ 5 = | a calcined china clay from ENGELHARD; |
| RILANIT ™ GMS = | a glycerine monotallow acid ester, from HENKEL AG |
| TMOS = | tetramethylorthosilicate hydrolyzed in the presence of methanesulphonic acid. |

*alkali salts converted into acid form by passing through an ion exchange column

COMPARATIVE EXAMPLES 1 TO 3 AND INVENTION EXAMPLES 1 TO 8

The substantially light-insensitive thermographic recording materials of COMPARATIVE EXAMPLES 1 to 3 and INVENTION EXAMPLES 1 to 8 were prepared by coating a a subbed 175 μm thick blue-pigmented polyethylene terephthalate support with CIELAB a*- and b*-values of −9.5 and −17.9 with the thermosensitive element type 1 via a 2-butanone dispersion with, after drying at 50° C. for 1 h in a drying cupboard, the above-mentioned composition.

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer with the composition:

| | |
|---|---|
| ERKOL ™ 48 20 = | 2.1 g/m$^2$ |
| LEVASIL ™ VP AC 4055 = | 1.05 g/m$^2$ |
| Surfactant = | 0.075 g/m$^2$ (of active ingredients) |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.71 g/m$^2$ (assuming that the TMOS was completely converted to $SiO_2$) |

After coating the protective layer was hardened by heating the substantially light-insensitive thermographic recording material at 45° C. for 7 days at a relative humidity of 70%.

Haze Measurements

Haze was determined as a percentage according to ASTM standard D1003 Haze-gard Plus apparatus from BYK GARDNER according to the expression:

$$\text{Haze, \%}=(T_d/T_t)\times 100$$

where $T_d$ is the diffuse luminous transmittance and $T_t$ is the total luminous transmittance. The haze values for the thermographic recording materials of COMPARATIVE EXAMPLES 1 to 3 and INVENTION EXAMPLES 1 to 8 are given in Table 1 below.

$R_z$ Measurements

The surface roughness of the protective layers, $R_z$, was determined according to DIN 4768/1. The $R_z$ values for the protective layers of the thermographic recording materials of COMPARATIVE EXAMPLES 1 to 3 and INVENTION EXAMPLES 1 to 8 are given in Table 1 below.

Thermographic Printing

The substantially light-insensitive thermographic recording materials of COMPARATIVE EXAMPLES 1 to 3 and INVENTION EXAMPLES 1 to 8 were printed using standard DRYSTAR™ 2000, 3000 and 4500 printer from AGFA-GEVAERT to produce different image densities. Density wedges were printed up to a maximum density ($D_{max}$) of 3.0 as measured through a visible filter with a MACBETH™ TR924 densitometer.

Dynamical Frictional Coefficients

The dynamic frictional coefficients were measured by modifying an AGFA DRYSTAR™ 2000 (thermal head) printer by incorporating a strain gauge so that the sideways strain generated by the recording materials in contact with the thermal head during the printing process could be determined. The electrical signal generated by the strain gauge coupled to the thermal head at load, L, of 330 g/cm of the thermal head and a transport speed of 4.5 mm/s was then converted into absolute dynamic frictional coefficients using a calibration curve generated by applying weights to the strain gauge. The dynamic frictional coefficients were measured by printing an image over the whole width of the thermal head consisting of 11 blocks each printed at different energies per dot and each with a non-printed strip in the middle thereof 2 mm wide in the printing direction and 18 cm long lateral to the printing direction, while printing the 2 mm wide and 2 cm long strips either side thereof. The dynamic frictional coefficient varied with print density. The maximum and minimum values were determined from a print out of strain gauge response in volts as a function of time in seconds (=position on the print) as shown in the Figure in EP-A 0 775 592. These values with the ratios of the maximum to the minimum value are given below in Table 1 for the thermographic recording materials of COMPARATIVE EXAMPLES 1 to 3 and INVENTION EXAMPLES 1 to 8.

Assessment of Diffusion of Ingredients and Reaction Products of the Imaging Forming Process to Protective Layer Surface The diffusion of ingredients and reaction products of the imaging forming process to the surface of the protective layer was assessed visually according to a scale of 0 to 5 with the following criteria:

| | |
|---|---|
| diffusion assessment of 0: | no diffusion |
| diffusion assessment of 1: | first indication of diffusion upon examination under an intense lighting after rubbing with a paper tissue |
| diffusion assessment of 2: | visible in daylight after rubbing with a paper tissue |
| diffusion assessment of 3: | just visible in daylight without rubbing with a paper tissue |
| diffusion assessment of 4: | moderately strong deposition without rubbing with a paper tissue |
| diffusion assessment of 5: | very strong deposition without rubbing with a paper tissue |

over 7 days at 45° C. and 70% relative humidity. The diffusion assessment values for the thermographic recording materials of COMPARATIVE EXAMPLES 1 to 3 and INVENTION EXAMPLES 1 to 8 are given in Table 1 below.

TABLE 1

| | Coating | thermo-sensitive element | | dynamical friction coefficients | | | haze | $R_z$ | diffusion |
|---|---|---|---|---|---|---|---|---|---|
| | series | type | Surfactant | min | max | ratio | [%] | [μm] | assessment |
| Comparative example nr. | | | | | | | | | |
| 1 | 1 | 1 | ULTRAVON W | 0.134 | 0.175 | 1.30 | 35.8 | 2.11 | 2 |
| 2 | 2 | 1 | ULTRAVON W | 0.121 | 0.175 | 1.44 | 38.0 | 2.26 | 1 |
| 3 | 3 | 1 | ULTRAVON W | 0.134 | 0.161 | 1.20 | 36.5 | 2.0 | 1 |
| Invention example nr. | | | | | | | | | |
| 1 | 1 | 1 | SURF 01 | 0.134 | 0.168 | 1.25 | 34.4 | 2.54 | 1 |
| 2 | 3 | 1 | SURF 02 | 0.134 | 0.168 | 1.25 | 38.7 | 2.4 | 1 |
| 3 | 3 | 1 | SURF 03 | 0.154 | 0.208 | 1.35 | 36.1 | 2.2 | 1 |
| 4 | 2 | 1 | SURF 04 | 0.128 | 0.161 | 1.26 | 36.0 | 2.74 | 2 |
| 5 | 2 | 1 | SURF 05 | 0.188 | 0.235 | 1.25 | 34.8 | 2.17 | 1 |
| 6 | 4 | 1 | SURF 06 | 0.148 | 0.168 | 1.14 | 31.0 | 2.16 | 1 |

TABLE 1-continued

| | Coating series | thermo-sensitive element type | Surfactant | dynamical friction coefficients min | max | ratio | haze [%] | $R_z$ [μm] | diffusion assessment |
|---|---|---|---|---|---|---|---|---|---|
| 7 | 2 | 1 | SURF 07 | 0.168 | 0.208 | 1.24 | 36.1 | 2.27 | 1 |
| 8 | 3 | 1 | SURF 08 | 0.134 | 0.168 | 1.25 | 36.1 | 2.2 | 1 |

The dynamic frictional coefficient, $R_z$, diffusion behaviour and haze of the thermographic recording materials of INVENTION EXAMPLE 1 to 8 with SURF 01 to SURF 08 do not differ significantly from those of the thermographic recording material of COMPARATIVE EXAMPLES 1 to 3 with ULTRAVON™ W.

CIELAB Measurements

The CIELAB a*- and b*-values of the prints for densities of 1.0 and 2.0 were determined by spectrophotometric measurements according to ASTM Norm E179-90 in a R(45/0) geometry with evaluation according to ASTM Norm E308-90, these densities principally determining the perception of the viewer.

Color neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive.

The a* and b* CIELAB-values for the fresh thermographic recording materials of COMPARATIVE EXAMPLES 1 to 3 and INVENTION EXAMPLES 1 to 8 are summarized in Table 2.

The CIELAB a*- and b*-values at densities of 1.0 and 2.0 for the fresh thermographic recording materials of INVENTION EXAMPLE 1 to 8 with SURF 01 to SURF 08 do not differ significantly from those of the thermographic recording material of COMPARATIVE EXAMPLE 1 to 3 with ULTRAVON™ W.

The thermographic recording materials of INVENTION EXAMPLES 1 to 8 containing the surfactants SURF 01 to 08 in their protective layers exhibited excellent image tone and contact behaviour with the thermal head, thereby being a real alternative to thermographic recording materials with ULTRAVON W in their protective layers, without the ecological problems concerning the synthesis of ULTRAVON™ W, the presence of photographically active impurities and the variable properties due to its varying composition due to its complex structure (25 ingredients).

Shelf-Life Experiments

The shelf-life of the thermographic recording materials of COMPARATIVE EXAMPLES 1 to 3 and INVENTION EXAMPLES 1 to 8 was evaluated by printing after 7 days in the dark at 45° C. in 70% relative humidity and determining the shifts for densities of 1.0 and 2.0 in CIELAB a*- and b*-values: Δa* and Δb*. The results are given in Table 3 below.

These results show a shelf-life performance for the thermographic recording materials of INVENTION

TABLE 2

| | Coating series | thermo-sensitive element type | Surfactant | CIELAB values for fresh film for D = 1.0 a* | b* | CIELAB values for fresh film for D = 2.0 a* | b* |
|---|---|---|---|---|---|---|---|
| Comparative example nr. | | | | | | | |
| 1 | 1 | 1 | Ultravon W | −4.42 | −9.39 | −1.89 | −6.36 |
| 2 | 2 | 1 | Ultravon W | −4.21 | −7.82 | −0.92 | −3.84 |
| 3 | 3 | 1 | Ultravon W | −4.27 | −8.78 | −0.58 | −5.16 |
| Invention example nr | | | | | | | |
| 1 | 1 | 1 | SURF 01 | −4.29 | −9.62 | −1.95 | −6.24 |
| 2 | 3 | 1 | SURF 02 | −4.26 | −8.46 | −0.78 | −4.84 |
| 3 | 3 | 1 | SURF 03 | −4.15 | −8.35 | −0.66 | −4.47 |
| 4 | 2 | 1 | SURF 04 | −4.34 | −7.92 | −1.03 | −4.47 |
| 5 | 2 | 1 | SURF 05 | −4.28 | −7.6 | −0.74 | −3.93 |
| 6 | 4 | 1 | SURF 06 | −4.09 | −8.43 | −2.51 | −6.72 |
| 7 | 2 | 1 | SURF 07 | −4.25 | −7.7 | −0.71 | −3.85 |
| 8 | 3 | 1 | SURF 08 | −4.28 | −8.59 | −0.61 | −4.87 |

EXAMPLES 2 to 5, 7 and 8 with surfactants SURF 02 to SURF 05, SURF 07 and SURF 08 in the protective layer, which is comparable or better than that exhibited by the COMPARATIVE EXAMPLES with the surfactant ULTRAVON W in the protective layer from the same coating series.

The shelf-life performance of the thermographic recording materials of INVENTION EXAMPLES 2, 3 and 8 with surfactants SURF 02, 03 and 08 is clearly superior, i.e. the shifts in a*- and b*-values taken together are smaller, to that of COMPARATIVE EXAMPLE 3 with the surfactant ULTRAVON W, coated in the same coating series.

The shelf-life performance of the thermographic recording materials of INVENTION EXAMPLES 7 with surfactant SURF 07 is clearly superior, i.e. the shifts in a*- and b*-values taken together are smaller, to that of COMPARATIVE EXAMPLE 2 with the surfactant ULTRAVON W, coated in the same coating series.

TABLE 3

| | Coating series | thermo-sensitive element type | Surfactant | ΔCIELAB values for fresh film for D = 1.0 Δa* | Δb* | ΔCIELAB values for fresh film for D = 2.0 Δa* | Δb* |
|---|---|---|---|---|---|---|---|
| Comparative example nr. | | | | | | | |
| 1 | 1 | 1 | ULTRAVON W | — | — | — | — |
| 2 | 2 | 1 | ULTRAVON W | +0.03 | +0.17 | −0.33 | +0.42 |
| 3 | 3 | 1 | ULTRAVON W | +0.25 | +1.64 | −0.05 | +1.18 |
| Invention example nr | | | | | | | |
| 1 | 1 | 1 | SURF 01 | — | — | — | — |
| 2 | 3 | 1 | SURF 02 | +0.10 | +1.21 | −0.04 | +0.75 |
| 3 | 3 | 1 | SURF 03 | +0.41 | +0.58 | +0.65 | +1.56 |
| 4 | 2 | 1 | SURF 04 | +0.15 | +0.31 | −0.07 | +0.78 |
| 5 | 2 | 1 | SURF 05 | +0.09 | +0.10 | −0.44 | +0.52 |
| 6 | 4 | 1 | SURF 06 | — | — | — | — |
| 7 | 2 | 1 | SURF 07 | +0.14 | −0.01 | −0.25 | +0.48 |
| 8 | 3 | 1 | SURF 08 | +0.35 | +0.32 | +0.54 | +1.06 |

COMPARATIVE EXAMPLES 4 TO 6 AND INVENTION EXAMPLES 9 TO 16

The substantially light-insensitive thermographic recording materials of COMPARATIVE EXAMPLES 4 to 6 and INVENTION EXAMPLES 9 to 16 were prepared as described for COMPARATIVE EXAMPLES 1 to 3 and INVENTION EXAMPLES 1 to 8 except that a type 2 thermosensitive element or a type 3 thermosensitive element was used instead of a type 1 thermosensitive element and the poly(ethylene terephthalate) support was 168 μm thick instead of 175 μm. The evaluation of the thermographic recording materials of COMPARATIVE EXAMPLES 4 to 6 and INVENTION EXAMPLES 9 to 16 was carried out as described for the thermographic recording materials of COMPARATIVE EXAMPLES 1 to 3 and INVENTION EXAMPLES 1 to 8. The results of the haze, $R_z$, dynamical frictional measurements and diffusion assessment for the thermographic recording materials of COMPARATIVE EXAMPLES 4 to 6 and INVENTION EXAMPLES 9 to 16 are summarized in Table 4 below.

The dynamic frictional coefficient, $R_z$, and diffusion behaviour of the thermographic recording material of INVENTION EXAMPLE 9 with SURF 01 was significantly more favourable than those for the thermographic recording material of COMPARATIVE EXAMPLE 4 with ULTRAVON™ W, the dynamic frictional coefficients and haze values not differing significantly.

The dynamic frictional coefficient, $R_z$, diffusion behaviour and haze of the thermographic recording materials of INVENTION EXAMPLE 10 to 16 with SURF 02 to SURF 08 did not differ significantly from those of the thermographic recording material of COMPARATIVE EXAMPLES 5 and 6 with ULTRAVON™ W.

TABLE 4

| | Coating series | thermo-sensitive element type | Surfactant | dynamical friction coefficients min | max | ratio | haze [%] | $R_z$ [μm] | diffusion assessment |
|---|---|---|---|---|---|---|---|---|---|
| Comparative example nr. | | | | | | | | | |
| 4 | 1 | 2 | ULTRAVON W | 0.134 | 0.168 | 1.25 | 32.9 | 1.90 | 2 |
| 5 | 2 | 3 | ULTRAVON W | 0.114 | 0.181 | 1.59 | 38.8 | 1.72 | 2 |
| 6 | 3 | 3 | ULTRAVON W | 0.121 | 0.188 | 1.56 | 39.3 | 2.10 | 2 |

TABLE 4-continued

| | Coating series | thermo-sensitive element type | Surfactant | dynamical friction coefficients min | max | ratio | haze [%] | $R_z$ [μm] | diffusion assessment |
|---|---|---|---|---|---|---|---|---|---|
| Invention example nr | | | | | | | | | |
| 9 | 1 | 2 | SURF 01 | 0.128 | 0.161 | 1.26 | 31.2 | 2.55 | 1 |
| 10 | 3 | 3 | SURF 02 | 0.121 | 0.188 | 1.56 | 39.4 | 3.0 | 2 |
| 11 | 3 | 3 | SURF 03 | 0.134 | 0.242 | 1.80 | 39.2 | 2.2 | 2 |
| 12 | 2 | 3 | SURF 04 | 0.107 | 0.195 | 1.81 | 39.4 | 2.13 | 3 |
| 13 | 2 | 3 | SURF 05 | 0.148 | 0.215 | 1.45 | 37.5 | 2.12 | 1 |
| 14 | 4 | 3 | SURF 06 | 0.121 | 0.188 | 1.56 | 34.6 | 2.21 | 2 |
| 15 | 2 | 3 | SURF 07 | 0.121 | 0.168 | 1.39 | 36.5 | 1.95 | 2 |
| 16 | 3 | 3 | SURF 08 | 0.128 | 0.188 | 1.47 | 37.4 | 1.8 | — |

The results of the CIELAB-measurements on the fresh thermographic recording materials of COMPARATIVE EXAMPLES 4 to 6 and INVENTION EXAMPLES 9 to 16 are summarized in Table 5 below.

TABLE 5

| | Coating series | thermo-sensitive element type | Surfactant | CIELAB values for fresh film for D = 1.0 a* | b* | CIELAB values for fresh film for D = 2.0 a* | b* |
|---|---|---|---|---|---|---|---|
| Comparative example nr. | | | | | | | |
| 4 | 1 | 2 | ULTRAVON W | −4.54 | −5.5 | −2.64 | −3.92 |
| 5 | 2 | 3 | ULTRAVON W | −4.63 | −9.48 | −2.4 | −6.01 |
| 6 | 3 | 3 | ULTRAVON W | −4.27 | −9.93 | −2.05 | −6.76 |
| Invention example nr | | | | | | | |
| 9 | 1 | 2 | SURF 01 | −4.64 | −5.84 | −2.77 | −4.09 |
| 10 | 3 | 3 | SURF 02 | −4.50 | −9.86 | −2.36 | −6.53 |
| 11 | 3 | 3 | SURF 03 | −4.25 | −8.85 | −2.27 | −5.74 |
| 12 | 2 | 3 | SURF 04 | −4.75 | −10.20 | −2.47 | −6.55 |
| 13 | 2 | 3 | SURF 05 | −4.81 | −9.96 | −2.2 | −6.12 |
| 14 | 4 | 3 | SURF 06 | −5.04 | −9.79 | −2.37 | −6.79 |
| 15 | 2 | 3 | SURF 07 | −4.74 | −9.81 | −2.42 | −6.3 |
| 16 | 3 | 3 | SURF 08 | −4.41 | −10.1 | −2.19 | −6.78 |

The CIELAB a*- and b*-values at densities of 1.0 and 2.0 for the thermographic recording material of INVENTION EXAMPLE 9 with SURF 01 did not differe significantly from those for the thermographic recording material of COMPARATIVE EXAMPLE 4 with ULTRAVON™ W.

The CIELAB a*- and b*-values at densities of 1.0 and 2.0 for the thermographic recording materials of INVENTION EXAMPLE 10 to 16 with SURF 02 to SURF 08 did not differ significantly from those of the thermographic recording material of COMPARATIVE EXAMPLES 5 and 6 with ULTRAVON™ W.

The thermographic recording materials of INVENTION EXAMPLES 9 to 16 containing the surfactants SURF 01 to 08 in their protective layers exhibited excellent image tone and contact behaviour with the thermal head, thereby being a real alternative to thermographic recording materials with ULTRAVON W in their protective layers, without the ecological problems concerning the synthesis of Ultravon W, the presence of photographically active impurities and the variable properties due to its varying composition due to its complex structure (25 ingredients).

The shelf-life of the thermographic recording materials of COMPARATIVE EXAMPLES 4 to 6 and INVENTION EXAMPLES 9 to 16 was evaluated as described for the thermographic recording materials of COMPARATIVE EXAMPLES 1 to 3 and INVENTION EXAMPLES 1 to 8. The results are given in Table 6 below.

These results show a shelf-life performance for the thermographic recording materials of INVENTION EXAMPLES 1 to 8 with surfactants SURF 01 to SURF 08 in the protective layer, which is comparable or better than that exhibited by the COMPARATIVE EXAMPLES with the surfactant ULTRAVON W in the protective layer from the same coating series.

The shelf-life performance of the thermographic recording materials of INVENTION EXAMPLE 9 with surfactant SURF 01 is clearly superior, i.e. the shifts in a*- and b*-values taken together are smaller, to that of COMPARATIVE EXAMPLE 4 with the surfactant ULTRAVON™ W, coated in the same coating series.

The shelf-life performance of the thermographic recording materials of INVENTION EXAMPLE 10 with surfactant SURF 02 is clearly superior, i.e. the shifts in a*- and b*-values taken together are smaller, to that of COMPARATIVE EXAMPLE 6 with the surfactant ULTRAVON™ W, coated in the same coating series.

TABLE 6

| | Coating series | thermo-sensitive element type | Surfactant | ΔCIELAB values for fresh film for D = 1.0 | | ΔCIELAB values for fresh film for D = 2.0 | |
|---|---|---|---|---|---|---|---|
| | | | | Δa* | Δb* | Δa* | Δb* |
| Comparative example nr. | | | | | | | |
| 4 | 1 | 2 | ULTRAVON W | +0.65 | +2.30 | +0.22 | +1.65 |
| 5 | 2 | 3 | ULTRAVON W | +0.44 | +0.57 | +0.02 | +0.31 |
| 6 | 3 | 3 | ULTRAVON W | +0.41 | +0.89 | +0.33 | +1.05 |
| Invention example nr | | | | | | | |
| 9 | 1 | 2 | SURF 01 | +0.40 | +0.56 | +0.06 | +0.50 |
| 10 | 3 | 3 | SURF 02 | +0.83 | +0.41 | +0.54 | +0.26 |
| 11 | 3 | 3 | SURF 03 | +0.76 | +1.39 | +0.75 | +1.32 |
| 12 | 2 | 3 | SURF 04 | +0.51 | +0.64 | +0.20 | +0.50 |
| 13 | 2 | 3 | SURF 05 | +0.67 | +0.53 | +0.19 | +0.19 |
| 14 | 4 | 3 | SURF 06 | +0.79 | +0.04 | +0.04 | +0.61 |
| 15 | 2 | 3 | SURF 07 | +0.64 | +0.46 | +0.11 | +0.33 |
| 16 | 3 | 3 | SURF 08 | +0.66 | +1.06 | +0.38 | +1.17 |

INVENTION EXAMPLE 17

The substantially light-insensitive thermographic recording materials of INVENTION EXAMPLES 17 was prepared as described for COMPARATIVE EXAMPLES 1 to 3 and INVENTION EXAMPLES 1 to 8 except that a type 3 thermosensitive element was used instead of a type 1 thermosensitive element, the poly(ethylene terephthalate) support was 168 μm thick instead of 175 μm and a different protective layer was used as given below.

The thermosensitive element was coated with an aqueous composition with the following ingredients, which was adjusted to a pH of 3.8 with 1 N nitric acid, to a wet layer thickness of 85 μm and then dried at 50° C. for 15 minutes to produce a protective layer with the composition:

| | |
|---|---|
| ERKOL ™ 48 20 = | 2.1 $g/m^2$ |
| LEVASIL ™ VP AC 4055 = | 1.05 $g/m^2$ |
| SURF 08 = | 0.075 $g/m^2$ |
| SYLOID ™ 72 = | 0.09 $g/m^2$ |
| SERVOXYL ™ VPDZ 3/100 = | 0.075 $g/m^2$ |
| SERVOXYL ™ VPAZ 100 = | 0.075 $g/m^2$ |
| MICROACE ™ TALC P3 = | 0.045 $g/m^2$ |
| SATINTONE ™ 5 = | 0.01 $g/m^2$ |

-continued

| | |
|---|---|
| RILANIT ™ GMS = | 0.15 $g/m^2$ |
| TMOS = | 0.71 $g/m^2$ (assuming that the TMOS was completely converted to $SiO_2$) |

After coating the protective layer was hardened by heating the substantially light-insensitive thermographic recording material at 45° C. for 7 days at a relative humidity of 70%.

The thermographic recording material of INVENTION EXAMPLE 17 exhibited excellent printing behaviour with reduced contamination of the thermal head during printing and a neutral image tone. The thermographic recording material exhibited excellent stability upon storage in the dark and prints exhibited excellent stability in archivability experiments.

COMPARATIVE EXAMPLES 7 TO 9 AND INVENTION EXAMPLE 18

The post-stabilization of a 30% by weight terpolymer latex of vinylidene chloride/methyl acrylate/itaconic acid (88/10/2 by weight) was investigated in an accelerated stability test at 60° C. in a drying cupboard and an autocoagulation test at 80° C. in a drying cupboard with different surfactants (see above). The results of these tests are shown in Table 7:

TABLE 7

| | Anionic surfactant | | time after which | time to |
|---|---|---|---|---|
| | type | quantity in g/100 g latex | settling first observed in stability test at 60° C. [h] | autocoagulation in autocoagulation test at 80° C. [h] |
| Comparative example nr | | | | |
| 7 | none | — | 14 | 8.5 |
| 8 | ARKOPON ™ T | 0.78 | 254 | 36.5 |
| 9 | ULTRAVON ™ W | 1.09 | 94 | 17.5 to 26.5 |
| Invention example nr | | | | |
| 18 | SURF 09 | 0.78 | >254 | >48 |

SURF 09, a 1:1 mixture of Compound 75 and Compound 78 exhibited significantly better post-stabilization behaviour compared with other surfactants including ULTRAVON™ W.

COMPARATIVE EXAMPLES 10 TO 12 AND INVENTION EXAMPLES 19 TO 21

The subbed-supports used in the overcoatability experiments of COMPARATIVE EXAMPLES 10 to 12 and INVENTION EXAMPLES 19 to 21 were prepared by coating both sides of a 350 μm thick poly(ethylene terephthalate) sheet already stretched in the length direction with an aqueous dispersion which after drying and transverse stretching produced a 100 μm thick support coated with the following conductive layer composition expressed as the coating weights of the ingredients present, being the first layer in the subbing layer system:

| | |
|---|---|
| # terpolymer latex of vinylidene chloride/methyl acrylate/itaconic acid (88/10/2): | 147 mg/m$^2$ |
| # colloidal silica (KIESELSOL ™ 100F from BAYER): | 16 mg/m$^2$ |
| # sorbitol | 25 mg/m$^2$ |
| # MERSOLAT ™ H80, a sodium hexadecyl-sulfonate from BAYER | 0.7 mg/m$^2$ |

The second layer of the subbing layer system was then applied as an aqueous dispersion to both sides of the 100 μm thick poly(ethylene terephthalate) support, which after drying at 130° C. produced the following composition expressed as the coating weights of the ingredients present:

| | |
|---|---|
| # gelatin (K 18435): | 190 mg/m$^2$ |
| # colloidal silica (KIESELSOL ™ 300F): | 170 mg/m$^2$ |
| # 3.2 μm polymethyl methacrylate latex particles: | 1 mg/m$^2$ |
| # 2-methyl-2,4-pentanediol: | 11 mg/m$^2$ |
| # trimethylolpropane | 5.6 mg/m$^2$ |
| # ARKOPAL ™ N060: | 3.3 mg/m$^2$ |
| # an anionic surfactant | 6.7 mg/m$^2$ |

These two layers together form the subbing layer systems of COMPARATIVE EXAMPLE 10 to 12 and INVENTION EXAMPLE 19 to 21.

The overcoatability of these subbing layer systems was evaluated with an aqueous antihalo layer coating dispersion with the composition after drying of:

| | |
|---|---|
| # gelatin (K 18114): | 3100 mg/m$^2$ |
| # colloidal silica (KIESELSOL ™ 300F): | 590 mg/m$^2$ |
| # terpolymer latex of methyl acrylate/acrylic acid/tetra-allyloxyethane (37/46.5/16.5): | 1400 mg/m$^2$ |
| # antihalo dye (see above): | 100 mg/m$^2$ |
| # MOBILCER ™ Q, a microcrystalline polyethylene wax from Mobil Oil: | 2.5 mg/m$^2$ |
| # glyoxal (HCOHCO) as hardener: | 72 mg/m$^2$ |
| # 7.5 μm polymethyl methacrylate latex particles: | 28 mg/m$^2$ |
| # ARKOPON ™ T: | 6 mg/m$^2$ |
| # NIAPROOF ANIONIC 4: | 1 mg/m$^2$ |
| # FLUORAD ™ FX1005: | 1.5 mg/m$^2$ |

The results obtained with a slide hopper (cascade) coating machine are given in Table 8 below:

TABLE 8

| | Anionic surfactant in second layer of subbing layer system | Coating speed (m/min) | Minimum vacuum in machine to obtain coating [Pa] | Coating length in cm needed to remedy coating faults e.g. induced by tape splice |
|---|---|---|---|---|
| Comparative example nr | | | | |
| 10 | ULTRAVON ™ W | 180 | 50 | 42 |
| 11 | ULTRAVON ™ W | 220 | 80 | 9* |
| 12 | ULTRAVON ™ W | 250 | 360 | 225* |
| Invention example nr | | | | |
| 19 | SURF 09 | 180 | 60 | 25 |
| 20 | SURF 09 | 220 | 50 | 9 |
| 21 | SURF 09 | 250 | 120 | 34 |

*coating fault not remedied at edges

It is clear from the results in Table 8, that the use of SURF 09 as an anionic surfactant in the second (outermost) layer of the subbing layer system instead of ULTRAVON™ W substantially improved the overcoatability of the subbing layer system with the antihalo layer coating dispersion, particularly at coating speeds of 220 to 250 m/minute where otherwise coating faults were not remedied at the edges of the coating.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

The invention claimed is:

1. A substantially light-insensitive monosheet thermographic recording material comprising a support and on one side of said support a thermosensitive element, wherein said thermographic recording material contains at least one compound represented by formula (I):

(I)

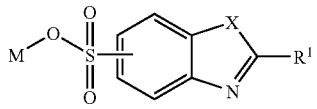

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; X is —O—, —S— or —N($R^2$)—; and $R^2$ is
hydrogen, a —$(CH_2)_mSO_3M$ group or a

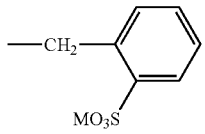

group; and m is an integer between 1 and 5.

2. Thermographic recording material according to claim 1, wherein said at least one compound represented by formula (I) is represented by formula (II):

(II)

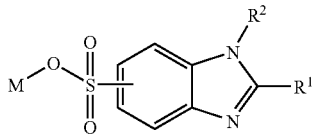

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; $R^2$ is hydrogen, a —$(CH_2)_mSO_3M$ group or a

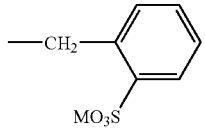

group; and m is an integer between 1 and 5.

3. Thermographic recording material according to claim 1, wherein said at least one compound represented by formula (I) is present in a subbing layer on at least one side of said support.

4. Thermographic recording material according to claim 1, wherein said thermosensitive element comprises at least one substantially light-insensitive silver salt of a carboxylic acid, at least one reducing agent therefor in thermal working relationship therewith and at least one binder.

5. Thermographic recording material according to claim 1, wherein said thermosensitive element is provided with an outermost protective layer.

6. Thermographic recording material according to claim 5, wherein said protective layer contains at least one compound represented by formula (I).

7. Thermographic recording material according to claim 5, wherein said outermost protective layer comprises the reaction product of at least one hydrolyzed polyalkoxysilane and a hydroxy-group containing polymer.

8. Thermographic recording material according to claim 7, wherein said polyalkoxysilane is tetramethoxysilane or tetra-ethoxysilane.

9. Thermographic recording material according to claim 7, wherein said hydroxy-group containing polymer is polyvinyl alcohol.

10. A substantially light-insensitive monosheet thermographic recording material comprising a support and on one side of said support a thermosensitive element, wherein said thermographic recording material comprises at least one compound represented by (III):

(III)

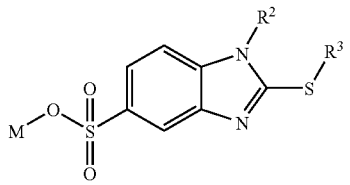

at least one compound represented by formula (IV):

(IV)

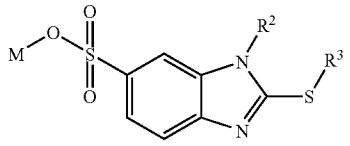

or a mixture of at least one compound represented by formula (III) with at least one compound represented by formula (IV), wherein M is hydrogen, an alkali atom or an aminonium group; $R^3$ is an alkyl, alkenyl or alkynyl group having 6 to 25 carbon atoms;

$R^2$ is hydrogen, a —$(CH_2)_m$ $SO_3M$ group or a

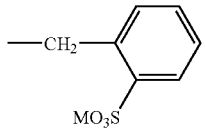

a group; and in is an integer between 1 and 5.

11. A thermographic recording material according to claim 10, wherein said at least one coinpound represented by formula (I) is present in a subbing layer on at least one side of said support.

12. A thermographic recording material according to claim 10, wherein said thermosensitive element comprises at least one substantially light-insensitive silver salt of a carboxylic acid, at least one reducing agent therefor in thermal working relationship therewith and at least one binder.

13. A thermographic recording material according to claim 10, wherein said thermosensitive element is provided with an outermost protective layer.

14. Thermographic recording material according to claim 13, wherein said protective layer comprises at least one compound represented by formula (I).

15. Thermographic recording material according to claim 13, wherein said outermost protective layer comprises the reaction product of at least one hydrolyzed polyalkoxysilane and a hydroxy-group containing polymer.

16. Thermographic recording material according to claim 15, wherein said polyalkoxysilane is tetramethoxysilafle or tetra-ethoxysilane.

17. Thermographic recording material according to claim 15, wherein said hydroxy-group containing polymer is polyvinyl alcohol.

18. Thermographic recording material according to claim 1, wherein $R^2$ is a —$(CH_2)_m$ $SO_3M$ group or a

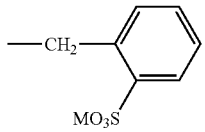

group.

19. Thermographic recording ijiaterial according to claim 2, wherein $R^2$ is a —$(CH_2)_m$ $SO_3M$ group or a

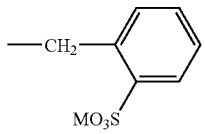

group.

* * * * *